US009283759B1

(12) United States Patent
Izawa et al.

(10) Patent No.: US 9,283,759 B1
(45) Date of Patent: Mar. 15, 2016

(54) INKJET RECORDING APPARATUS

(71) Applicant: MIYAKOSHI PRINTING MACHINERY CO., LTD., Narashino-shi, Chiba (JP)

(72) Inventors: Hideo Izawa, Narashino (JP); Yuuichi Yamazaki, Narashino (JP)

(73) Assignee: MIYAKOSHI PRINTING MACHINERY CO., LTD., Narashino-shi, Chiba (JP)

( * ) Notice: Subject to any disclaimer, the term of this patent is extended or adjusted under 35 U.S.C. 154(b) by 0 days.

(21) Appl. No.: 14/844,763

(22) Filed: Sep. 3, 2015

(30) Foreign Application Priority Data

Mar. 13, 2015 (JP) ..... 2015-51459

(51) Int. Cl.
*B41J 2/14* (2006.01)

(52) U.S. Cl.
CPC ..... *B41J 2/1433* (2013.01)

(58) Field of Classification Search
CPC ..... B41J 2/1631; B41J 2/1433; B41J 2/1623; B41J 2/162; B41J 2/1628
USPC ..... 347/47, 40
See application file for complete search history.

(56) References Cited

U.S. PATENT DOCUMENTS

2013/0215198 A1* 8/2013 Izawa ..... B41J 23/025 347/40

FOREIGN PATENT DOCUMENTS

JP 2007-283639 A 11/2007
JP 2011-152708 A 8/2011

* cited by examiner

*Primary Examiner* — Manish S Shah
*Assistant Examiner* — Yaovi Ameh
(74) *Attorney, Agent, or Firm* — Flynn, Thiel, Boutell & Tanis, P.C.

(57) ABSTRACT

An inkjet recording apparatus of a line head type where a resolution can be changed simply, and locating of nozzles can be performed simply and accurately is provided.

The present invention is an inkjet recording apparatus 100 performing recording to a recording medium 1 using line heads H, wherein the inkjet recording apparatus 100 is provided with a rectangular first base plate 11, a rectangular second base plate 21, and a plurality of the line heads H arranged on the first base plate and the second base plate, wherein a side end of one side of the first base plate 11 has a step-like upper projection portion 12, a side end of the other side of the second base plate 21 has a step-like lower projection portion 22, the upper projection portion 12 and the lower projection portion 22 overlap each other so as to come in surface contact with each other in a vertical direction, and the first base plate 11 and the second base plate 21 are provided side by side in a state where a distal end of the lower projection portion 22 has been caused to abut on the first base plate 11, wherein a resolution is changed by finely moving the second base plate 21 to the first base plate 11 in a longitudinal direction.

12 Claims, 12 Drawing Sheets

FIG.4( a )
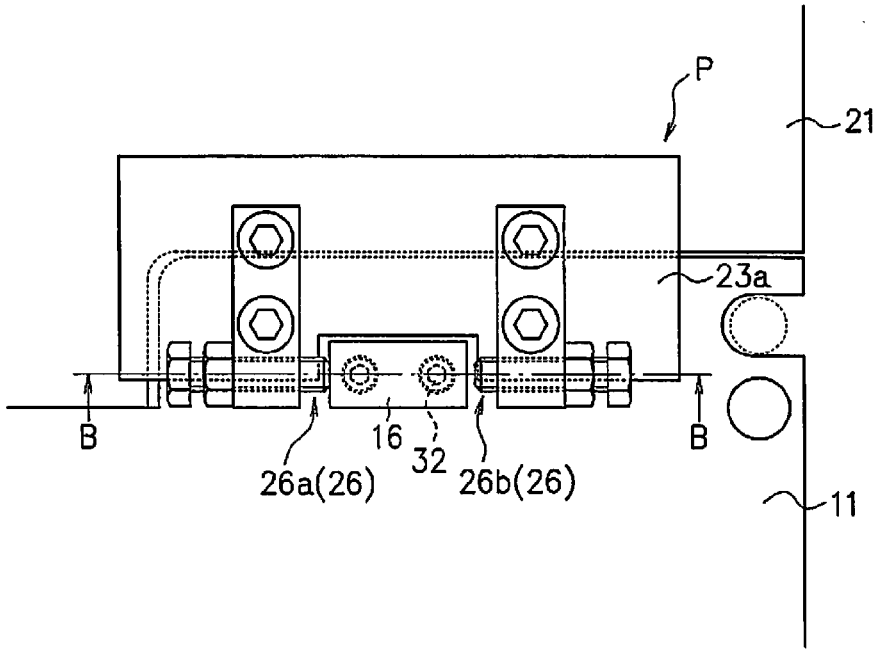
FIG.4( b )
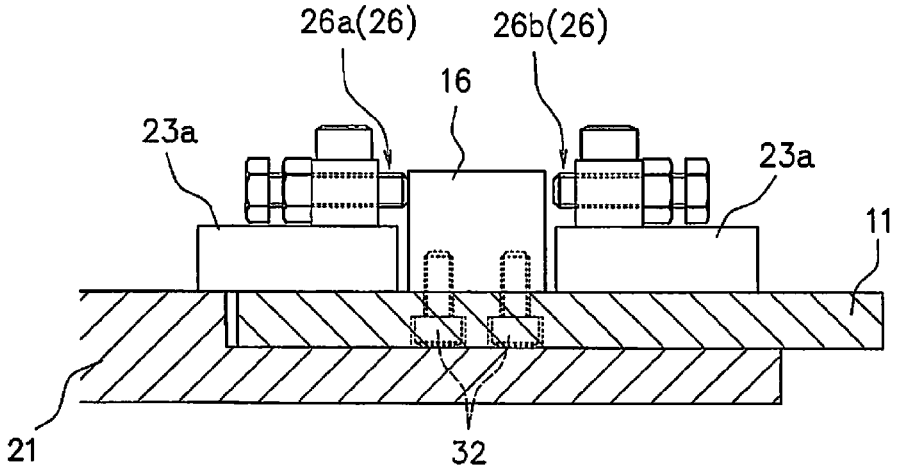

FIG.8( a )
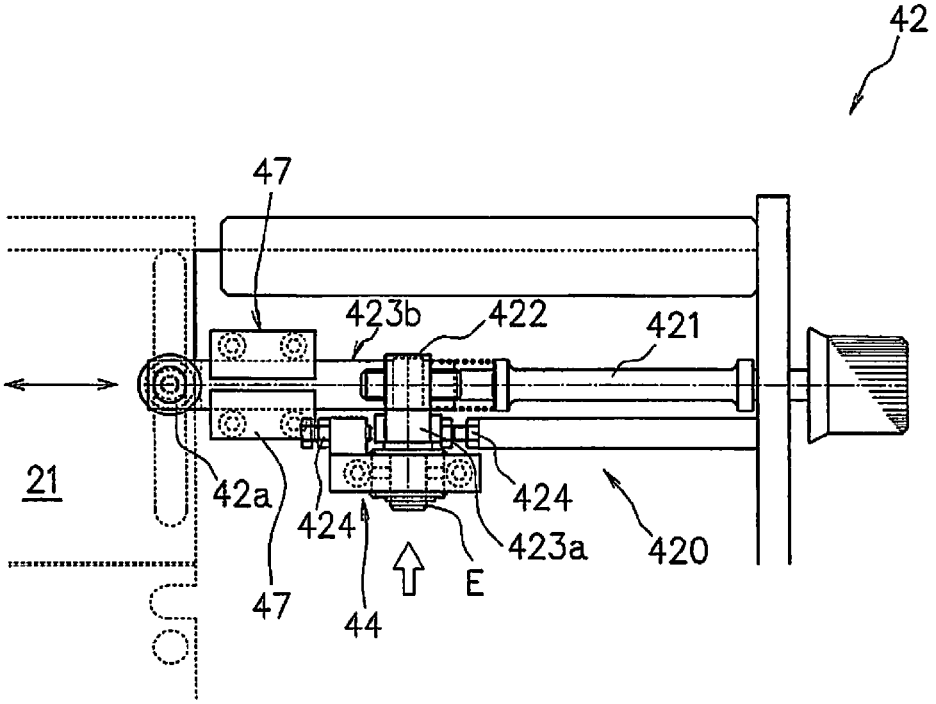
FIG.8( b )
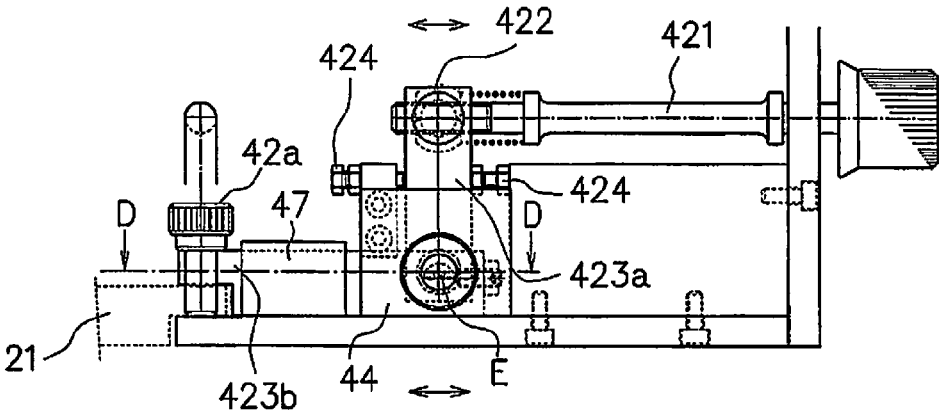

FIG.10( a )
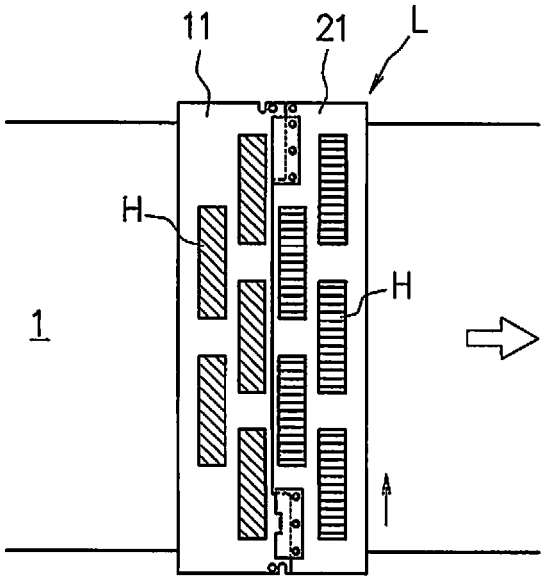
FIG.10( b )
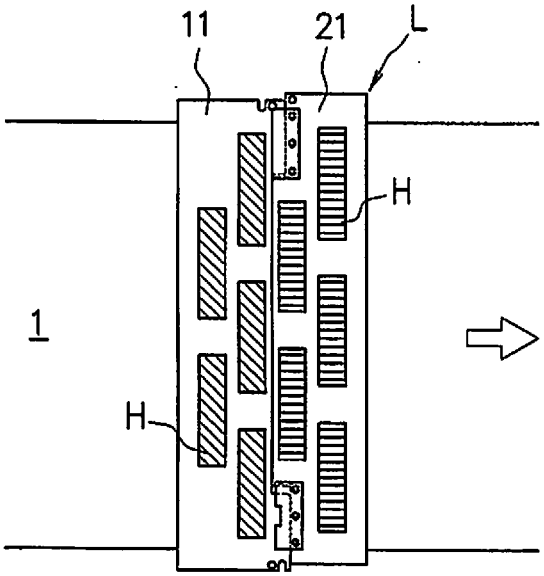

FIG.11( a )
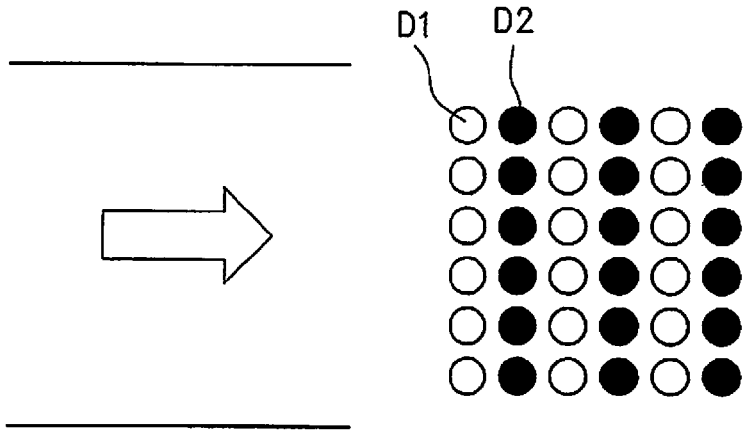
FIG.11( b )
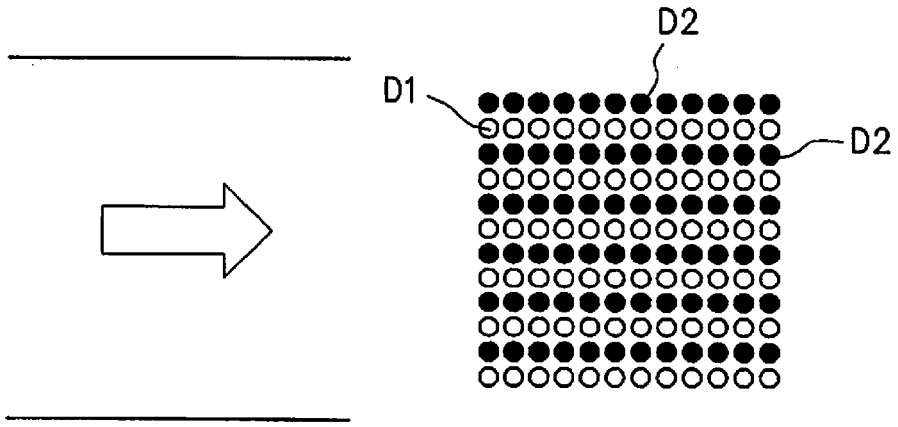

INKJET RECORDING APPARATUS

TECHNICAL FIELD

The present invention relates to an inkjet recording apparatus, and in particular to an inkjet recording apparatus of a line head type where a resolution can be changed simply and locating of nozzles can be performed simply and precisely.

BACKGROUND ART

An inkjet recording apparatus of a line head type performing recording to a recording medium using line heads.

Generally, in recording using the inkjet recording apparatus, an expressive power of an image is largely changed according to a resolution. It should be noted that the term "resolution" means, for example, the number of particles (hereinafter, called "dot") of ink per one inch (2.54 cm).

Further, the resolution includes two directions of a running direction of a recording medium and a vertical direction to the running direction of the recording medium, and when either of both the directions or both the directions are set to a high resolution, it is necessary to make sizes of dot particles relatively small.

Now, in the inkjet recording apparatus, when the resolution in the running direction of the recording medium is set to a high resolution, a fine image expression becomes possible. However, since a distance between dots in the running direction becomes short, when the number of discharging of ink is constant or is limited, it is necessary to perform an operation under a condition that a moving velocity of the recording medium is a low velocity, which results in deterioration of productivity.

On the other hand, when the resolution is set to a low resolution, since the distance between dots becomes large, it is made possible to perform an operation at a high velocity, which results in production of only a coarse image expression.

Further, when the resolution in the vertical direction to the running direction of the recording medium is set to a high resolution, it is necessary to achieve such a high resolution by arrangement of head nozzles.

In recent years, in the printing industry, it is required to change the resolution according to an image required to perform recording reasonably.

On the other hand, for example, a liquid discharging apparatus (an inkjet recording apparatus) provided with a first nozzle row where a plurality of nozzles are arranged in a row direction, a second nozzle row where a plurality of nozzles are arranged in a row direction, and a moving mechanism moving the second nozzle row in the row direction is known (for example, see PTL1).

Further, an inkjet printing apparatus (an inkjet recording apparatus) configured such that except for at least one of a plurality of line heads where a multiplicity of inkjet nozzles are arranged in a row fashion, the remaining line heads are made movable in the nozzle row direction is known (for example, see PTL2).

According to these inkjet recording apparatuses, the resolution can be changed for each lot by moving the nozzle row(s).

CITATION LIST

Patent Literature

PTL 1: Japanese Patent Application Laid-Open No. 2007-283639

PTL 2: Japanese Patent Application Laid-Open No. 2011-152708

SUMMARY OF INVENTION

Technical Problem

In the above-described PTL1 and PTL2, however, the resolution can be changed, but there is such a drawback that the heads must be moved individually, which results in complication of work.

Further, there is also such a drawback that after the heads are moved, adjustment of positions of the nozzles becomes troublesome.

The present invention has been made in view of the above circumstances, and an object thereof is to provide an inkjet recording apparatus where a resolution can be changed simply and locating of nozzles can be performed simply and precisely.

Solution to Problems

The inventors have made intensive research to solve the above problems and have completed the present invention based upon the finding that the above problems can be solved by providing a first base plate with a plurality of line heads arranged and a second base plate with a plurality of line heads arranged side by side in a specific arrangement and finely moving the second base plate to the first base plate from this state.

The present invention lies in (1) an inkjet recording apparatus performing recording to a recording medium using line heads, wherein the inkjet recording apparatus is provided with a rectangular first base plate, a rectangular second base plate, and a plurality of line heads arranged on the first base plate and the second base plate, wherein a side end of one side of the first base plate has a step-like upper projection portion, a side end of the other side of the second base plate has a step-like lower projection portion, the upper projection portion and the lower projection portion overlap each other vertically so as to come in surface contact with each other and the first base plate and the second base plate are arranged side by side in a state where a distal end of the lower projection portion has been caused to abut on the first base plate, wherein a resolution is changed by finely moving the second base plate to the first base plate in a longitudinal direction.

The present invention lies in (2) the inkjet recording apparatus according to the above (1), wherein a nozzle pitch in the line heads is constant and the second base plate is finely moved to the first base plate by ½ of the nozzle pitch.

The present invention lies in (3) the inkjet recording apparatus according to the above (1) or (2), wherein a coupling block is fixed on the second base plate, a projection-like guide portion is provided on a lower face of the coupling block, an elongated groove portion extending in the longitudinal direction is provided on an upper face of the first base plate, and the guide portion is inserted in the elongated groove portion.

The present invention lies in (4) the inkjet recording apparatus according to any one of the above (1) to (3), wherein an adjusting block is fixed on the first base plate, a coupling block is fixed on the second base plate, and a stopper is attached on the coupling block, wherein when the second base plate is not finely moved, a gap is provided between a distal end of the stopper and the adjusting block, and when the second base plate has been finely moved, the distal end of the stopper is caused to abut on the adjusting block.

The present invention lies in (5) the inkjet recording apparatus according to the above (4), wherein a pair of stoppers are attached on the second base plate via the coupling block, and the adjusting block is arranged between the stoppers.

The present invention lies in (6) the inkjet recording apparatus according to any one of the above (1) to (5), wherein a through-hole is provided in the upper projection portion, a hole with a bottom is provided in the lower projection portion, and a locating pin can be fitted from the side of the through-hole in a state where the through-hole and the hole with a bottom are caused to coincide with each other.

The present invention lies in (7) the inkjet recording apparatus according to any one of the above (1) to (6), further comprising a head box having a notched portion, wherein the first base plate and the second base plate are attached to a depth side of the notched portion, a lid portion temporarily fixing the first base plate and the second base plate simultaneously is attached to a near side of the notched portion, the lid portion is composed of a first guide tool coupled to the first base plate, a second guide tool coupled to the second base plate, and a front portion supporting the first guide tool and the second guide tool, wherein the first base plate can be finely turned by actuating the first guide tool, and the second base plate can be finely moved by actuating the second guide tool.

The present invention lies in (8) the inkjet recording apparatus according to the above (7), wherein the first guide tool is composed of a first connection mechanism pivoted to the first base plate via a first coupling pin, a first nut attached with the first connection mechanism, and a first screw shaft attached with the first nut, and wherein the first base plate is finely turned by rotating the first screw shaft.

The present invention lies in (9) the inkjet recording apparatus according to the above (8), wherein the first connection mechanism is composed of a supporting portion extending in a horizontal direction approximately orthogonal to the first screw shaft, and a fulcrum portion attached to a distal end of the supporting portion, the supporting portion is attached to the first nut, and a center shaft of the fulcrum portion is fixed and one end of the fulcrum portion is pivoted to the first base plate via the first coupling pin.

The present invention lies in (10) the inkjet recording apparatus according to the above (7) or (8), wherein the second guide tool is composed of a second connection mechanism attached to the second base plate via a second coupling pin, a second nut attached with the second connection mechanism, and a second screw shaft attached with the second nut, wherein the second base plate is finely moved by rotating the second screw shaft.

The present invention lies in (11) the inkjet recording apparatus according to the above (10), wherein the second connection mechanism is composed of a width member finely movable in a front-rear direction and a depth member attached to the width member via an eccentric pin, the depth member is attached to the second nut, and the width member is attached to the second base plate via the second coupling pin.

The present invention lies in (12) the inkjet recording apparatus according to the above (10) or (11), wherein stoppers are provided ahead of and behind the depth member.

Advantageous Effects of Invention

In the inkjet recording apparatus of the present invention, the first base plate with a plurality of line heads arranged and the second base plate with a plurality of line heads arranged are provided side by side, and the resolution can be changed by finely moving the second base plate to the first base plate.

At this time, since the upper projection portion of the first base plate and the lower projection portion of the second base plates overlap each other vertically so as to come in surface contact with each other, the position of the second base plate to the first base plate in a height direction is located. Further, since the distal end of the lower projection portion of the second base plate is caused to abut on the first base plate, the position of the second base plate to the first base plate in a widthwise direction (a vertical direction to the longitudinal direction of the base plates) is located. Therefore, when the second base plate is finely moved, it is required to adjust only the position of the second base plate in the longitudinal direction, the locating of the second base plate can be performed simply.

In the inkjet recording apparatus of the present invention, since the nozzle pitch in the line heads (an interval between nozzles) is constant, and the resolution can be made double by finely moving the second base plate to the first base plate by only ½ of the nozzle pitch.

In the inkjet recording apparatus of the present invention, since the guide portion on the lower face of the coupling block fixed to the second base plate is inserted in the elongated groove portion in the upper face of the first base plate, the position of the second base plate to the first base plate in the widthwise direction is firmly located.

Further, since the second base plate is finely moved in the state where the guide portion has been inserted in the elongated groove portion, the second base plate is securely prevented from wobbling relative to the first base plate in the widthwise direction.

In the inkjet recording apparatus of the present invention, for example, a gap equivalent to ½ of the nozzle pitch is provided between the distal end of the stopper attached on the second base plate via the coupling block and the adjusting block fixed on the first base plate at a position where the second base plate is not finely moved (hereinafter, also called "first position"), and the distal end of the stopper can be caused to abut on the adjusting block at a position where the second base plate has been finely moved (hereinafter, also called "second position"), so that the position of the second base plate can be arranged from the first position to the second position simply.

Further, when the pair of stoppers are attached to the second base plate via the coupling block, and the adjusting block is arranged between the stoppers, for example, arrangement at the first position or at the second position can be achieved simply by causing the adjusting block to abut on one of the stoppers and setting a gap equivalent to ½ of the nozzle pitch between the adjusting block and the other stopper from such a state that respective gaps are provided between the pair of stoppers and the adjusting block. By finely adjusting setting positions of both the stoppers to the adjusting block, the first position and the second position can be finely adjusted.

In the inkjet recording apparatus of the present invention, by fitting the locating pin from the side of the through-hole in the state where the through-hole provided in the upper projection portion and the hole with a bottom provided in the lower projection portion have been caused to coincide with each other, for example, locating the first base plate at the first position and the second base plate in the longitudinal direction can be performed simply as an initial stage.

In the inkjet recording apparatus of the present invention, since the first base plate can be finely turned by actuating the first guide tool of the lid portion, inclinations of the first base plate and the second base plate in the horizontal direction can be corrected by using the first guide tool.

At this time, since such a configuration is adopted that the first guide tool is composed of the first connection mechanism, the first nut, and the first screw shaft, and the first base plate is finely turned by rotating the first screw shaft, the first base plate and the second base plate can be finely turned easily.

Further, when the first connection mechanism is composed of the supporting portion extending in a horizontal direction approximately orthogonal to the first screw shaft, and the fulcrum portion attached to the distal end of the supporting portion, the supporting portion is attached to the first nut, the center shaft of the fulcrum portion is fixed and one end of the fulcrum portion is pivoted to the first base plate via the first coupling pin, fine turning amounts of the first base plate and the second base plate to a rotation amount of the first screw shaft can be made small, so that the fine turning amounts of the first base plate and the second base plate can be adjusted precisely.

Further, the fine turning amounts of the first base plate and the second base plate can also be made large or can also be made small by changing the screw pitch of the first screw shaft.

In the inkjet recording apparatus of the present invention, since the second base plate can be finely moved by actuating the second guide tool of the lid portion, resolution switching can be performed by using the second guide tool.

At this time, since such a configuration is adopted that the second guide tool is composed of the second connection mechanism, the second nut and the second screw shaft, and the second base plate is finely moved by rotating the second screw shaft, the second base plate can be finely moved easily.

Further, when the second connection mechanism is composed of the widthwise member finely movable in the front-rear direction and the depth member attached to the widthwise member via the eccentric pin, and the depth member is attached to the second nut, and the widthwise member is attached to the second base plate via the second coupling pin, a fine movement amount of the widthwise member to a rotation amount of the second screw shaft can be made small, so that the fine movement amount of the widthwise member can be adjusted precisely.

Further, the fine movement amount of the widthwise member can also be made large and can also be made small by changing the screw pitch of the second screw shaft.

In addition, when the stoppers are provided ahead of and behind the depth member, the depth member is prevented from moving excessively in the front-rear direction.

BRIEF DESCRIPTION OF DRAWINGS

FIG. 4(*a*) is an enlarged plan view of the first attaching portion of the inkjet recording apparatus according to the embodiment, and FIG. 4(*b*) is a cross sectional view taken along a face B-B in FIG. 4(*a*);

FIG. 8(*a*) is a plan view showing a second guide tool in the inkjet recording apparatus according to the embodiment, and FIG. 8(*b*) is a side view of the second guide tool;

FIG. 10(*a*) is a plan view showing an outline of a positional relationship between the line head portion and a recording medium when a second base plate is located at a first position in the inkjet recording apparatus according to the embodiment, and FIG. 10(*b*) is a plan view showing an outline of a positional relationship between the line head portion and the recording medium when the second base plate is located at a second position;

FIG. 11(*a*) is a descriptive view for describing an arrangement of dots recorded by the line head portion when the second base plate is located at the first position in the inkjet recording apparatus according to the embodiment, and FIG. 11(*b*) is a descriptive view for describing an arrangement of dots recorded by the line head portion when the second base plate is located at the second position.

DESCRIPTION OF EMBODIMENTS

Figure 1:
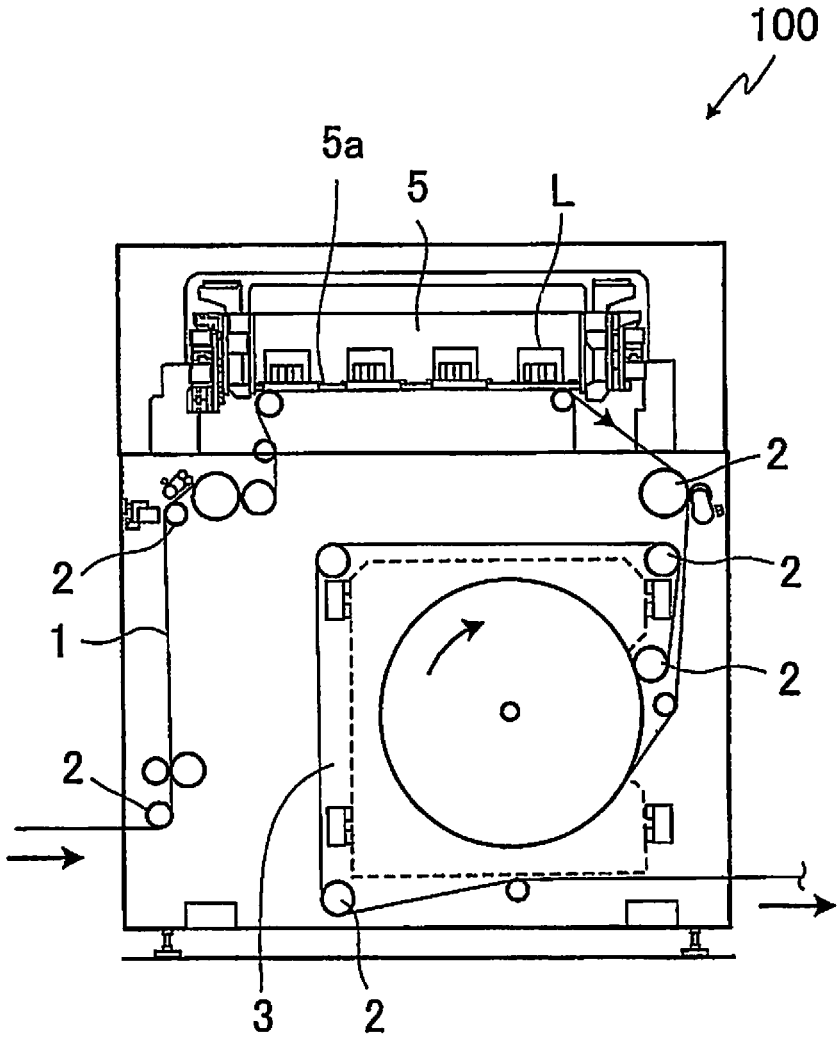
FIG. 1 is a front view showing an outline of an inkjet recording apparatus according to an embodiment of the present invention.

Hereinafter, with reference to Figures, if necessary, preferred embodiments of the present invention will be described in detail. It should be noted that in the drawings, identical elements are denoted by identical reference signs so that the same description is not repeated. In addition, positional relationships, such as top and bottom or right and left, are based upon positional relationships in Figures, unless otherwise noted. Further, dimensions ratios of the drawings are not limited to those shown in Figures.

FIG. 1 is a front view showing an outline of an inkjet recording apparatus according to an embodiment of the present invention.

As shown in FIG. 1, an inkjet recording apparatus 100 according to the embodiment is provided with a line head portion L having a plurality of line heads performing recording to a running recording medium 1, a head box 5 accommodating the line head portion L, a plurality of guide rollers 2 guiding the recording medium 1, and a drying machine 3 for drying the recording medium 1 on which recording has been performed by the line head portion L. That is, the inkjet recording apparatus 100 according to the embodiment is configured as an inkjet recording apparatus of a line head type using fixed line heads.

It should be noted that as the recording medium 1, for example, a commercially-available member such as a paper, a cloth, a film, a metal foil or the like can be adopted appropriately.

Further, the drying machine 3 has a cylindrical dryer and is configured such that the recording medium 1 is dried by bringing the recording medium 1 on which inkjet recording has been performed in close contact with a surface of the dryer.

In the inkjet recording apparatus 100, the recording medium 1 conveyed is guided by the guide rollers 2 and is subjected to inkjet recording by the line head portion L.

Then, the inkjet-recorded recording medium 1 is guided by another guide roller 2 to reach the drying machine 3 and is dried. Thereafter, the dried recording medium 1 is guided by another guide roller 2 to be conveyed to the outside.

Figure 2:
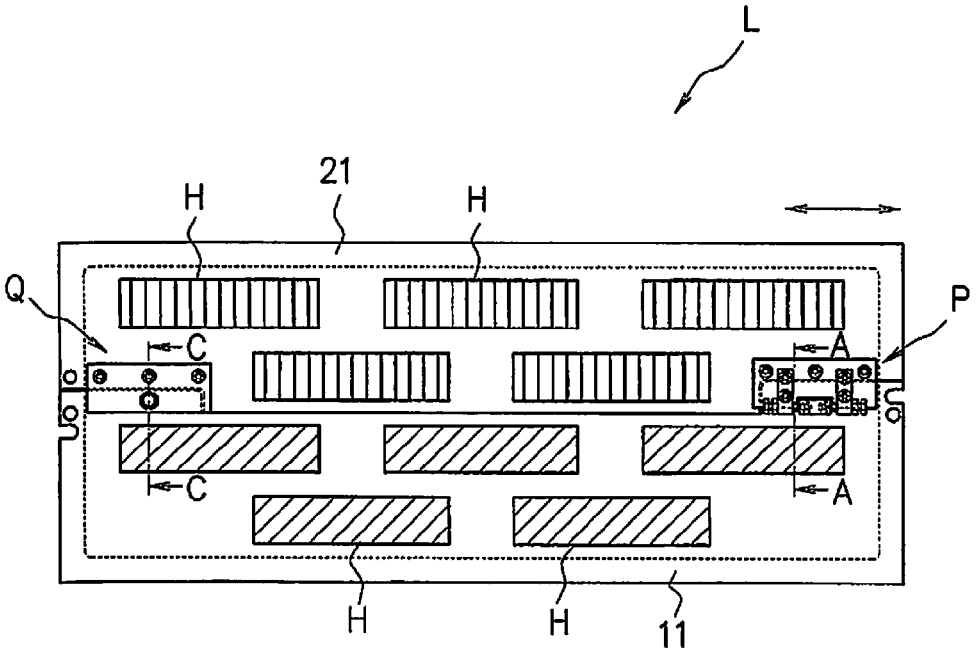
FIG. 2 is a plan view showing a line head portion of the inkjet recording apparatus according to the embodiment.

FIG. 2 is a plan view showing the line head portion of the inkjet recording apparatus according to the embodiment.

As shown in FIG. 2, the line head portion L is provided with a rectangular first base plate 11, a rectangular second base plate 21, and a plurality of line heads H arranged on the first base plate 11 and the second base plate 21.

Such a configuration is obtained that the first base plate 11 having a plurality of line heads H arranged and the second base plate 21 having a plurality of line heads H arranged are provided side by side.

Here, the first base plate 11 and the second base plate 21 are attached to each other via two front and rear attaching portions P and Q (hereinafter, also called "first attaching portion P" and "second attaching portion Q") described later.

A resolution in a vertical direction to a running direction of a recording medium can be changed by finely moving the second base plate 21 to the first base plate 11 in a longitudinal direction in directions of arrows. Details of this matter will be described later.

Figure 3:
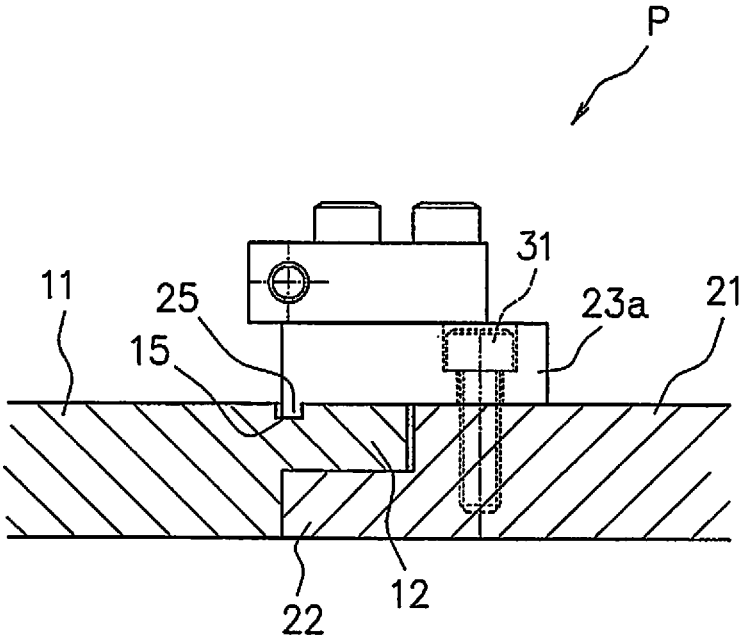
FIG. 3 is a partial cross sectional view showing a first attaching portion taken along a face A-A in FIG. 2.

FIG. 3 is a partial cross sectional view showing the first attaching portion P taken along a face A-A in FIG. 2.

As shown in FIG. 3, in the first attaching portion P, a surface of the first base plate 11 and a surface of the second base plate 21 are flush with each other. Thereby, a distance from a nozzle face of the line head H provided on the first base plate 11 to the recording medium and a distance from a nozzle face to the line head H provided on the second base plate 21 to the recording medium become the same. Therefore, it is possible to use line heads H of the same type in the first base plate 11 and the second base plate 21.

Further, workability when cleaning, maintenance or the like is performed is also improved.

In the first attaching portion P, the first base plate 11 has a step-like upper projection portion 12 provided on a side end of one side thereof, while the second base plate 21 has a step-like lower projection portion 22 provided on a side end of the other side thereof.

Further, a lower face of the upper projection portion 12 and an upper face of the lower projection portion 22 overlap each other vertically so as to come in surface contact with each other, and a distal end of the lower projection portion 22 is caused to abut on the first base plate 11.

Since the upper projection portion 12 and the lower projection portion 22 overlap each other so as to come in surface contact with each other in this manner, a position of the second base plate 21 to the first base plate 11 in a height direction can be located.

Further, the distal end of the lower projection portion 22 is caused to abut on the first base plate 11, so that a position of the second base plate 21 to the first base plate 11 in a widthwise direction thereof (a vertical direction to the longitudinal direction of the base plates, a crosswise direction in FIG. 3) can be located. Thereby, when the second base plate 21 is finely moved, it is necessary to adjust only the position of the second base plate 21 in the longitudinal direction, so that locating of the second base plate 21 can be performed simply and accurately.

Here, a distal end of the upper projection portion 12 is not caused to abut on the second base plate 21. Thereby, friction occurring when the second base plate 21 is finely moved to the first base plate 11 can be reduced. As a result, the second base plate 21 can be finely moved smoothly.

It should be noted that, as described above, since the distal end of the lower projection portion 22 is caused to abut on the first base plate 11, the locating of the second base plate 21 to the first base plate 11 in the widthwise direction is performed, where since such a matter that the number of reference faces utilized for the locating is one makes it easy to obtain a high precision, which is desirable, a gap is provided between the upper projection portion 12 and the second base plate 21.

Further, in the attaching portion P, a coupling block 23*a* is fixed on an upper face of the second base plate 21 by a bolt 31, and a projection-like guide portion 25 is provided on a lower face of the coupling block 23*a*.

On the other hand, an elongated groove portion 15 extending in the longitudinal direction is provided on an upper face of the first base plate 11.

The guide portion 25 is inserted in the elongated groove portion 15.

In the first attaching portion P, such a configuration is adopted that the coupling block 23*a* and the lower projection portion 22 sandwiches the upper projection portion 12 from the above and the below, and the guide portion 25 on the lower face of the coupling block 23*a* is inserted in the elongated groove portion 15 of the first base plate and is caused to abut on a side wall of the elongated groove portion 15 on the side of the second base plate. Thereby, the distal end of the lower projection portion 22 is caused to abut on the first base plate 11 with a proper abutting force.

Therefore, since the second base plate 21 is finely moved in such a state that the distal end of the lower projection portion 22 has been caused to abut on the first base plate 11 with a proper abutting force, the second base plate 21 can be prevented from wobbling relative to the first base plate 11 in the widthwise direction during the fine movement.

It should be noted that a gap is provided between a lower face of the guide portion 25 and a bottom face of the elongated groove portion 15.

FIG. 4(*a*) is an enlarged plan view of the first attaching portion P of the inkjet recording apparatus according to the embodiment, and FIG. 4(*b*) is a cross sectional view taken along a face B-B in FIG. 4(*a*).

As shown in FIGS. 4(*a*) and 4(*b*), in the first attaching portion P, an adjusting block 16 is fixed on an upper face of the first base plate 11 by a bolt 32.

Further, the coupling block 23*a* described above is fixed on the upper face of the second base plate 21.

Such a coupling block 23*a* is formed in a U shape as viewed from the above, and stoppers 26 are attached to a pair of projecting portions of the coupling block 23*a*. It should be noted that the adjusting block 16 is arranged between both the stoppers 26.

At this time, a rear end (the left side in FIG. 4(*a*)) of the adjusting block 16 is caused to abut on a stopper 26*a* (26) behind the adjusting block 16, and a gap is provided between a front end (the right side in FIG. 4(*a*)) and a stopper 26*b* (26) ahead of the adjusting block 16.

It should be noted that in this specification, regarding the fine movement of the adjusting block, a downstream side is defined as "front" and an upstream side is defined as "rear". Further, "ahead of" and "behind" are similarly defined.

In the inkjet recording apparatus 100, when the second base plate 21 is not finely moved (the state shown in FIGS. 4(*a*) and 4(*b*)), namely, when the second base plate 21 is located at the first position, recording is performed in a state where a gap exists between a distal end of the stopper 26*b* ahead of the adjusting block 16 and a front end of the adjusting block 16. It should be noted that at this time, a distal end of the stopper 26*a* behind the adjusting block 16 has been caused to abut on the rear end of the adjusting block 16.

On the other hand, when the second base plate 21 has been finely moved, namely, when the second base plate 21 is located at the second position, recording is performed in a state where the front end of the adjusting block 16 has been caused to abut on the stopper 26*b* ahead of the adjusting block 16. It should be noted that at this time, a gap occurs between a distal end of the stopper 26*a* behind the adjusting block 16 and the rear end of the adjusting block 16.

Here, the distances of these gaps are set to be equivalent to a distance of ½ of the nozzle pitch of the line head H of the first base plate 11 in order to arrange each nozzle of the line head H of the second base plate 21 in the nozzle pitch of the line head H of the first base plate 11 by finely moving the second base plate 21. The resolution in the vertical direction to the running direction of the recording medium can be made double by the fine movement.

By these matters, in the inkjet recording apparatus 100, the position of the second base plate 21 to the first base plate 11 in the longitudinal direction can be located simply by causing the adjusting block 16 to abut on any one of the stoppers 26. As a result, it is made possible to simply change the resolution in the vertical direction to the running direction of the recording medium.

Further, the position (the first position or the second position) of the second base plate 21 can be finely adjusted respectively at a recording time by finely adjusting the positions of both the stoppers 26.

Figure 5:
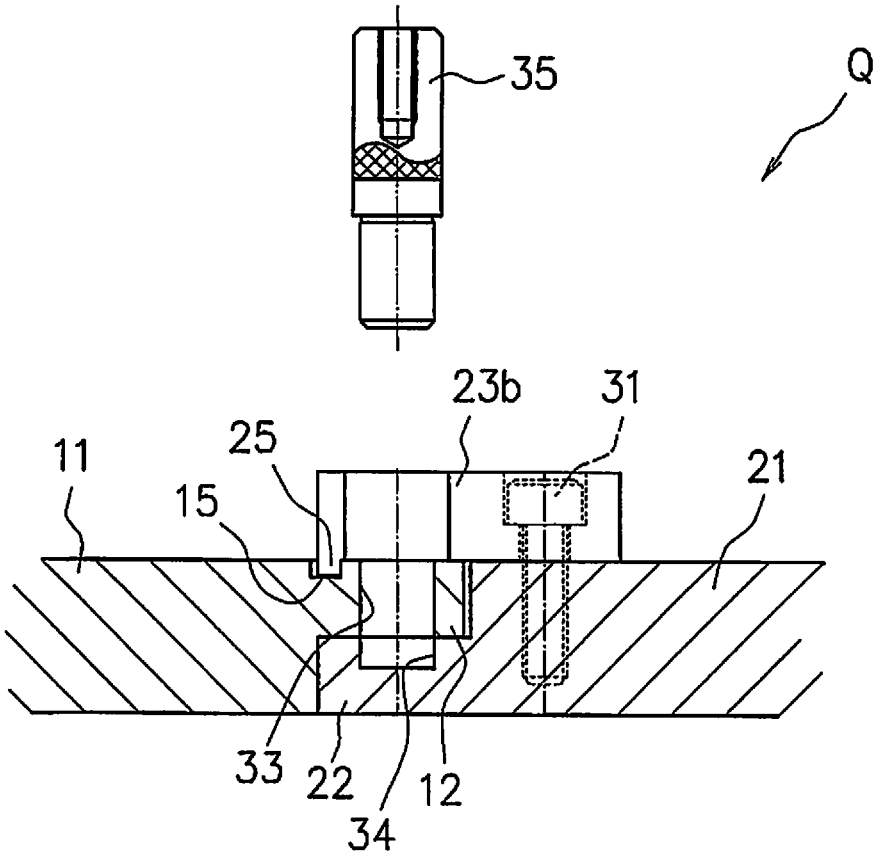
FIG. 5 is a partial cross sectional view showing a second attaching portion taken along a face C-C in FIG. 2.

FIG. 5 is a partial cross sectional view showing a second attaching portion Q taken along a face C-C in FIG. 2.

As shown in FIG. 5, in the second attaching portion Q, the first base plate 11 has a step-like upper projection portion 12 provided on a side end of one side of the first base plate 11, while the second base plate 21 has a step-like lower projection portion 22 provided on a side end of the other side of the second base plate 21.

A lower face of the upper projection portion 12 and an upper face of the lower projection portion 22 overlap each other so as to come in surface contact with each other, and a distal end of the lower projection portion 22 is caused to abut on the first base plate 11.

Further, in the second attaching portion Q, a coupling block 23*b* is fixed on an upper face of the second base plate 21 by a bolt 31. A projection-like guide portion 25 is provided on a lower face of the coupling block 23*b*.

On the other hand, an elongated groove portion 15 extending in the longitudinal direction is provided on the upper face of the first base plate 11.

The guide portion 25 is inserted in the elongated groove portion 15.

That is, the second attaching portion Q has a structure similar to that of the first attaching portion P regarding an arrangement relationship between these first base plate 11 and second base plate 21.

Here, in the second attaching portion Q, a through-hole 33 extending in a vertical direction is provided in the upper projection portion 12, while a hole with a bottom 34 extending in the vertical direction is provided in the lower projection portion 22, which is different from the first attaching portion P.

A locating pin 35 can be fitted from the side of the through-hole 33 in a state where the through-hole 33 and the hole with a bottom 34 have been caused to coincide with each other.

Further, the distal end of the lower projection portion 22 is caused to abut on the first base plate 11, so that the position of the second base plate 21 to the first base plate 11 in the widthwise direction is located.

It should be noted that since the precision is increased easily in such a case the number of references utilized for locating is only one, which is desirable, either one of the through-hole 33 and the hole with a bottom 34 may be formed in a hole slightly elongated in the widthwise direction (in the crosswise direction in FIG. 5) of the base plates to the locating pin 35.

In the second attaching portion Q, when the second base plate 21 has been assembled to the first base plate 21, locating in such a case that the second base plate 21 is located at the first position where the stopper 26*a* has abutted on the rear end of the adjusting block 16 can be performed easily by fitting the locating pin 35 in both the through-hole 33 and the hole with a bottom 34. That is, locating of the second base plate 21 to the first base plate 11 in an initial stage can be performed simply. It should be noted that the locating pin 35 is removed when the second base plate 21 is finely moved.

Here, a method for determining the positions of the first position and the second position will be described.

First, the first base plate 11 and the second base plate 21 are coupled to each other by the coupling blocks 23*a* and 23*b* in such a state that they are immovable to each other in the running direction (a short-axis direction on the base plate) of the recording medium.

At this time, in the first attaching portion P, both the stoppers 26 provided so as to sandwich the adjusting block 16 are set in a state where they are not caused to abut on the adjusting block 16.

The locating pin 35 is fitted in the coupling block 23*b* of the second attaching portion Q.

This state constitutes the first position described above.

Next, positional adjustment (alignment) of the individual line heads H is performed in order to achieve a positional coincidence between the nozzles of the line heads H on the first base plate 11 and the nozzles of the line heads H on the second base plate 21 in a vertical direction to the running direction of the recording medium with each other at the first position.

Further, at this time, only the stopper 26*a* of the pair of stoppers 26 provided on the second base plate 21 via the coupling block 23*a*, which is located behind the adjusting block 16, is caused to abut on the adjusting block 16 and the stopper 26*a* is locked.

It should be noted that when a positional deviation has occurred between the nozzles of the line heads H on the first base plate 11 and the nozzles of the second base plate 21, the line heads H are moved using a first guide tool 41 described later to correct the positional deviation.

Next, the second position is set. First, prior to the setting, the locating pin 35 which has been fitted in the coupling block 23*b* of the second attaching portion Q is pulled out in advance.

At the second position, only the stopper 26*b* of the pair of stoppers 26 provided on the second base plate 21 via the coupling block 23*a*, which is located ahead of the adjusting block 16, is caused to abut on the adjusting block 16 and the stopper 26*b* is locked.

Returning to FIG. 1, in the inkjet recording apparatus 100 according to this embodiment, the line head portion L is accommodated in the head box 5.

Specifically, the line head portion L is attached on a base plate 5*a* on a lower face of the head box 5.

Figure 6:
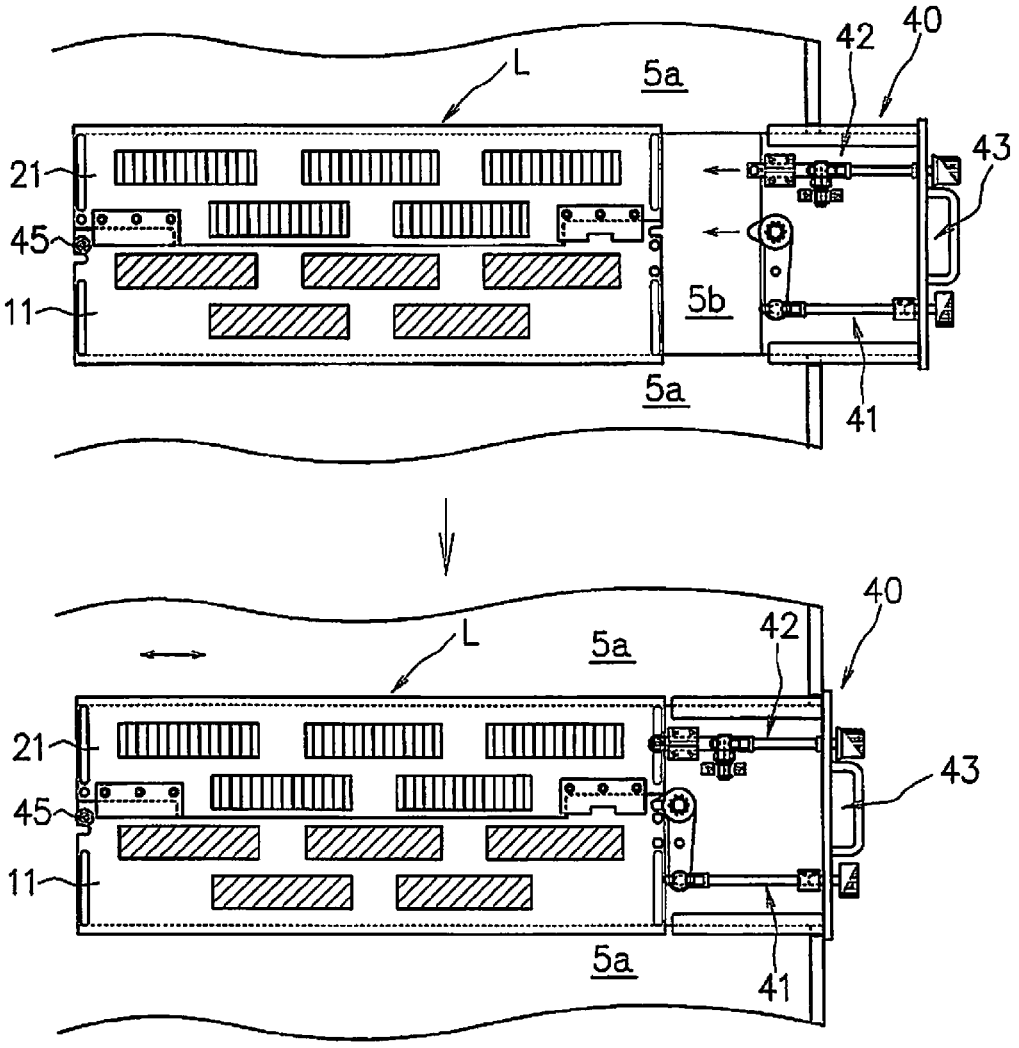
FIG. 6 is a plan view showing a state where the line head portion and a lid portion of the inkjet recording apparatus according to the embodiment have been attached to a head box.

FIG. 6 is a plan view showing a state where the line head portion L and the lid portion 40 of the inkjet recording apparatus 100 according to this embodiment have been attached to the head box 5.

As shown in FIG. 6, in the inkjet recording apparatus 100, a rectangular notched portion 5*b* is provided in the base plate 5*a* of the head box 5.

The first base plate 11 and the second base plate 21 constituting the line head portion L are attached to the depth side of the notched portion 5*b*, while the lid portion 40 temporarily fixing the first base plate 11 and the second base plate 21 simultaneously is attached to the near side of the notched portion 5*b*.

The lid portion 40 is composed of a first guide tool 41 coupled to the first base plate 11, a second guide tool 42 coupled to the second base plate 21, and a front portion 43 supporting the first guide tool 41 and the second guide tool 42. It should be noted that the first guide tool 41 is attachable to and detachable from the first base plate 11, while the second guide tool 42 is attachable to and detachable from the second base plate 21.

In the inkjet recording apparatus 100, the first base plate 11 can be finely turned about an attachable and detachable fulcrum pin 45 located on the opposite side of the base plate 11 in the longitudinal direction by actuating the first guide tool 41 in a state where the first guide tool 41 and the second guide tool 42 have been connected to corresponding first base plate 11 and second base plate 21, respectively, and the second base plate 21 can be finely moved by actuating the second guide tool 42.

Figure 7:
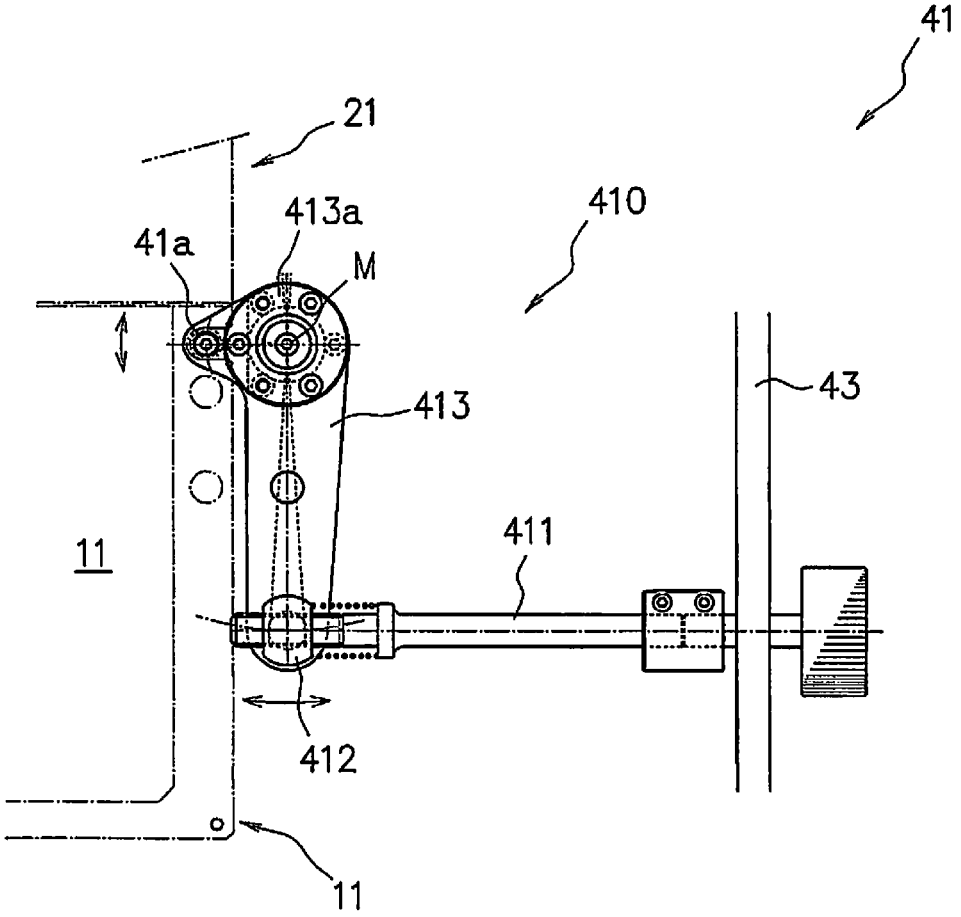
FIG. 7 is a plan view showing a first guide tool in the inkjet recording apparatus according to the embodiment.

FIG. 7 is a plan view showing the first guide tool 41 in the inkjet recording apparatus according to this embodiment.

As shown in FIG. 7, the first guide tool 41 is composed of a first connection mechanism 410 pivoted to the first base plate 11 via a first coupling pin 41*a*, a first nut 412 attached with the first connection mechanism 410, and a rod-like first screw shaft 411 attached with the first nut 412 and rotatably supported to the front portion 43.

The first connection mechanism 410 is composed of a supporting portion 413 attached to the first nut 412 and extending in a horizontal direction approximately orthogonal to the first screw shaft 411, and a fulcrum portion 413*a* provided at a distal end of the supporting portion 413.

Further, one end of the fulcrum portion 413*a* is pivoted to the first base plate 11 via the first coupling pin 41*a*.

In the first guide tool 41, a center shaft M of the fulcrum portion 413*a* is fixed to a bottom face plate of the lid portion (not shown). Therefore, by rotating the first screw shaft 411, the first nut 412 is slid and the supporting portion 413 is turned about the center shaft M, and the first coupling pin 41*a* is also turned according to the turning of the supporting portion 413, so that the first base plate 11 is finely turned in a direction of arrow about the attachable and detachable fulcrum pin 45 located on the opposite side of the base plate 11 in the longitudinal direction in a state where the first base plate 11 has been coupled to the second base plate 21.

In the inkjet recording apparatus 100, since the first base plate 11 can be finely turned about the attachable and detachable fulcrum pin 45 located on the opposite side of the base plate 11 in the longitudinal direction by actuating the first guide tool 41 of the lid portion 40, inclinations of the first base plate 11 and the second base plate 21 coupled to the first base plate in the horizontal direction can be corrected using the first guide tool 41. As a result, a deviation of the nozzle position to the recording medium 1 can be corrected.

Figure 9:
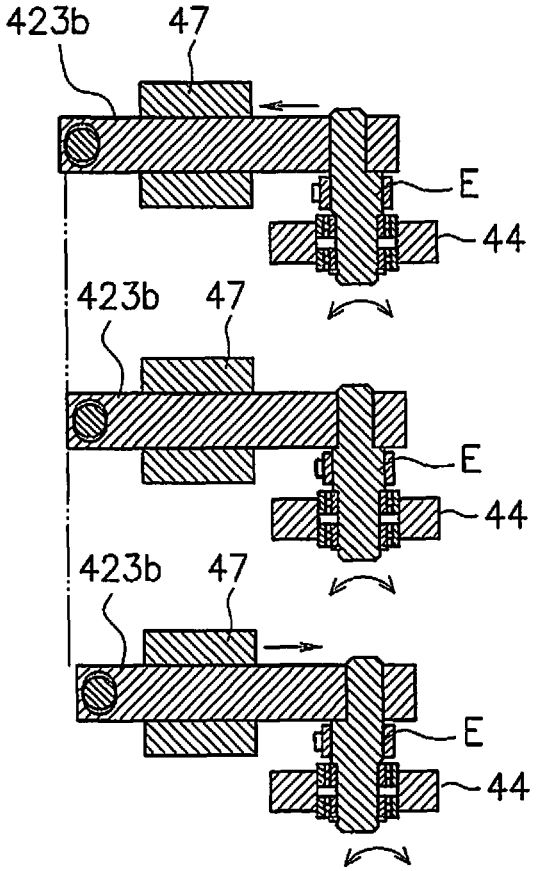
FIG. 9 is a schematic cross sectional view for describing movement of a second connection mechanism taken along a face D-D in FIG. 8(*b*)

FIG. 8(*a*) is a plan view showing the second guide tool 42 in the inkjet recording apparatus according to this embodiment, FIG. 8(*b*) is a side view of the second guide tool 42, and FIG. 9 is an illustrative cross sectional view for describing movement of the second communication mechanism, taken along a face D-D in FIG. 8(*b*).

As shown in FIGS. 8(*a*) and 8(*b*), the second guide tool 42 is composed of a second connection mechanism 420 attached to the second base plate 21 via a second coupling pin 42*a*, a second nut 422 attached with the second connection mechanism 420, and a second screw shaft 421 attached with the second nut 422.

The second connection mechanism 420 is composed of a width member 423*b* finely movable in a front-rear direction and a depth member 423*a* attached to the width member 423*b* via an eccentric pin E.

Further, the depth member 423*a* is attached to the second nut 422, while the width member 423*b* is attached to the second base plate 21 via the second coupling pin 42*a*.

Further, in the second guide tool 42, a pair of stoppers 424 are provided ahead of and behind the depth member 423*a*.

In the second guide tool 42, a bracket 44 is fixed to the bottom face plate of the lid portion 40, and an eccentric pin E is attached to the bracket 44 via a bearing. That is, the eccentric pin E is turnably attached to bracket 44.

A lower end side of the depth member 423*a* is fixed to the eccentric pin E and an upper end side thereof is coupled to the second nut 422.

It should be noted that a fixing and coupling center between the eccentric pin E and the depth member 423*a* and a turning bearing center between the eccentric pin E and the bracket 44 are made coaxial.

Therefore, the depth member 423*a* is turnable forward and rearward about the eccentric pin E based upon forward and rearward movements of the second nut 422. At this time, the eccentric pin E itself is also turned according to turning of the depth member 423*a*.

A side of the width member 423*b* located at the side of the second base plate 21 is attachably and detachably coupled to the second base plate 21 by the second coupling pin 42*a*, the opposite side thereof is formed with a vertical elongated hole having the same width as the diameter of the eccentric pin E, the eccentric pin E is inserted in the vertical elongated hole, and the width member 423*b* is attached to the eccentric pin E so as not to prevent turning of the eccentric pin E.

Therefore, the width member 423*b* is finely moved forward and rearward based upon turning of the eccentric pin E (see FIG. 9). At this time, since a hole inserted with the eccentric pin E is a vertical elongated hole in the width member 423*b*, eccentricity in the vertical direction according to turning of the eccentric pin E is enabled by the vertical elongated hole, so that movement of the width member 423*b* in the vertical direction is prevented.

In the second guide tool 42, by rotating the second screw shaft 421, the second nut 422 is moved, and the depth member 423*a* is turned and the eccentric pin E is turned in an eccentric manner, so that the width member 423*b* is moved in the horizontal direction (in the front-rear direction).

Thereby, fine movement of the second base plate 21 to the first base plate 11 is performed.

It should be noted that at this time, a pair of guide pieces 47 are provided on the bottom face plate of the lid portion 40. Therefore, during the fine movement, the width member 423*b* is guided along the guide pieces 47 by sliding both side faces and an upper face of the width member 423*b* on the inside of the guide pieces 47.

In the inkjet recording apparatus 100, since the second base plate 21 is finely moved by actuating the second guide tool 42 of the lid portion 40, resolution switching can be simply performed by using the second guide tool 42.

Further, since the stoppers 424 are provided ahead of and behind the depth member 423*a* of the second guide tool 42, the depth member 423*a* is prevented from moving excessively.

FIG. 10(*a*) is a plan view showing an outline of a positional relationship between the line head portion and the recording medium when the second base plate is located at the first position in the inkjet recording apparatus according to the embodiment, and FIG. 10(*b*) is a plan view showing an outline of a positional relationship between the line head portion and the recording medium when the second base plate is located at the second position.

Further, FIG. 11(*a*) is a descriptive view for describing an arrangement of dots recorded by the line head portion when the second base plate is located at the first position in the inkjet recording apparatus according to the embodiment, and FIG. 11(*b*) is a descriptive view for describing an arrangement of dots recorded by the line head portion when the second base plate is located at the second position. It should be noted that a dot D1 is indicated by "○" while a dot D2 is indicated by "●".

As shown in FIGS. 10(*a*) and 10(*b*), in the inkjet recording apparatus 100, the recording medium 1 is conveyed in a vertical direction to the longitudinal direction of the line head portion L.

Here, in each head line H, such a configuration is adopted that nozzles (not shown) are arranged at fixed intervals (pitches), and ink accommodated in the line head H is discharged from the nozzles.

When the second base plate 21 is located at the first position, as shown in FIG. 10(*a*), the positions of the line heads H on the first base plate 11 of the line head portion L and the positions of the line heads H on the second base plate 21 thereof are coincident with each other. It should be noted that it is possible to move the first guide tool 41 to correct a deviation of a nozzle position, if necessary.

In this case, when recording is continuously performed on the conveyed recording medium 1 several times by the line head portion L, as shown in FIG. 11(*a*), dots D2 recorded by the line heads H on the second base plate 21 can be assigned to the same rows as those of dots D1 recorded by the line heads H on the first base plate 11 in the running direction of the recording medium.

On the other hand, when the second base plate 21 is located at the second position by finely moving the second base plate 21 to the first base plate 11 by ½ of the nozzle pitch using the second guide tool 42, as shown in FIG. 10(*b*), the positions of the line heads H on the first base plate 11 of the line head portion L and the positions of the line heads H on the second base plate 21 are not coincident with each other.

In this case, since dots D2 recorded by the line heads H on the second base plate 21 can be each assigned between dots D1 recorded by the line heads H on the first base plate 11, the resolution in the vertical direction to the running direction of the recording medium is made double.

At this time, since recording on the same row in the running direction of the recording medium 1 is performed by only the dots D1 or the dots D2, it is preferable that such a processing that the number of discharges per unit time of each line head H is increased to, for example, four times or the running speed of the recording medium 1 is reduced to, for example, ¼ times is performed.

Thereby, since the resolution in the running direction of the recording medium is made double, as shown in FIG. 11(*b*), an inkjet recording apparatus where the resolution in the vertical direction to the running direction of the recording medium is double, and the resolution in the running direction of the recording medium 1 is also double is made possible.

From these matters, according to the inkjet recording apparatus 100 according to this embodiment, by finely moving the second base plate 21 to the first base plate 11, the resolution in the vertical direction to the running direction of the recording medium can be changed simply.

Though the embodiment of the present invention has been described above, the present invention is not limited to the above embodiment.

For example, in the inkjet recording apparatus 100 according to this embodiment, the configurations of the first base plate 11 and the second base plate 21 may be reversed to each other. That is, a configuration for finely moving the first base plate 11 to the second base plate 21 can be adopted.

In the inkjet recording apparatus 100 according to this embodiment, though the first base plate 11 and the second base plate 21 are attached to each other via the two attaching portions P and Q ("first attaching portion P" and "second attaching portion Q"), only one attaching portion may be provided, or the inkjet recording apparatus 100 may have three or more attaching portions. It should be noted that when only one attaching portion is provided, it is preferable that the configuration of the first attaching portion described above is adopted.

Further, when only one attaching portion is provided, a configuration obtained by combining the attaching portions P and Q can be adopted.

In the inkjet recording apparatus 100 according to this embodiment, though the surface of the first base plate 11 and the surface of the second base plate 21 are made flush with each other, such a configuration is not an essential configuration necessarily.

In the inkjet recording apparatus 100 according to this embodiment, though the coupling block 23*a* is formed in a U shape as viewed from the above, and the stoppers 26 are attached at the two projecting portions of the coupling block 23*a*, respectively, the projecting portions may be independent from each other, respectively. That is, respective stoppers may be attached to the respective coupling blocks.

Further, the second base plate may have only one stopper via the coupling block 23*a*. In this case, the rear end of the adjusting block 16 is caused to abut on a predetermined fixing reference and a gap is provided between the front end of the adjusting block 16 and the stopper.

In the inkjet recording apparatus 100 according to this embodiment, though locating in the case where the second base plate 21 is located at the first position is performed by fitting the locating pin 35 in the through-hole 33 and the hole with a bottom 34 from the side of the through-hole 33, the through-hole 33 and the hole with a bottom 34 may be provided at positions where the locating can be performed when the second base plate 21 is located at the second position.

It should be noted that a plurality of through-holes and a plurality of holes with a bottom may be provided in order to make locating possible in both the case where the second base plate 21 is located at the first position and the case where the second base plate 21 is located at the second position.

In the inkjet recording apparatus 100 according to this embodiment, though the lid portion 40 is composed of the first guide tool 41 coupled to the first base plate 11, the second guide tool 42 coupled to the second base plate 21, and the front portion 43 supporting the first guide tool 41 and the second guide tool 42, such a configuration is not an essential configuration necessarily.

Further, the structures of the first guide tool 41 and the second guide tool 42 are not also limited to those described above.

Figure 12:
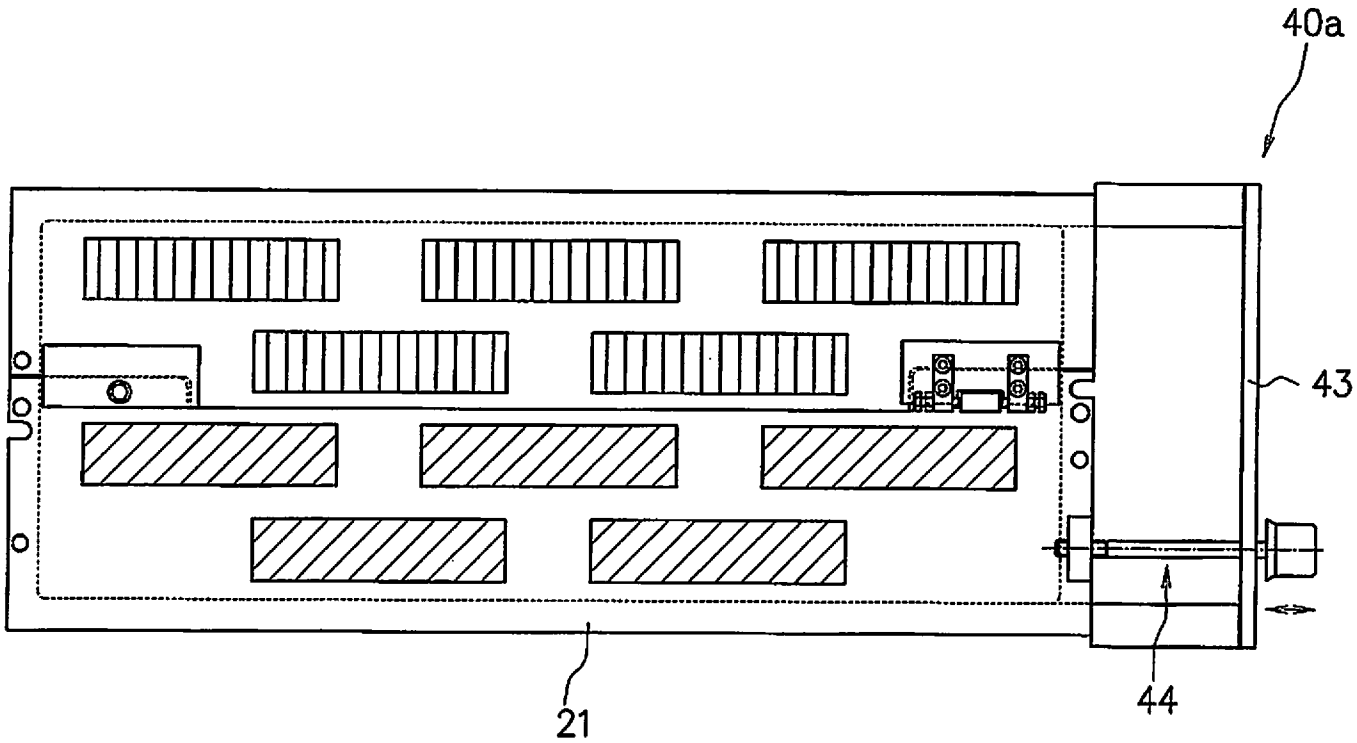
FIG. 12 is a plan view showing the line head portion and the lid portion of the inkjet recording apparatus according to another embodiment.

FIG. 12 is a plan view showing a line head portion and a lid portion in an inkjet recording apparatus according to another embodiment.

As shown in FIG. 12, in the inkjet recording apparatus according to the another embodiment, a lid portion 40*a* is composed of a rod-like second guide tool 44' coupled to the second base plate 21 and a front portion 43 rotatably supporting the second guide tool 44'.

In the above inkjet recording apparatus, the second base plate 21 can be finely moved by actuating (rotating) the second guide tool (screw shaft) 44'.

INDUSTRIAL APPLICABILITY

The inkjet recording apparatus of the present invention can be utilized as an inkjet recording apparatus of a line head type performing recording to a recording medium using line heads. According to the inkjet recording apparatus of the present invention, the resolution in the vertical direction to the running direction of the recording medium can be changed simply and locating the nozzles can be performed simply and accurately.

REFERENCE SIGNS LIST

1 . . . recording medium,
2 . . . guide roller,
3 . . . drying machine,
5 . . . head box,
5*a* . . . base plate,
5*b* . . . notched portion,
100 . . . inkjet recording apparatus,
11 . . . first base plate,
12 . . . upper projection portion,
15 . . . elongated groove portion,
16 . . . adjusting block,
21 . . . second base plate,
22 . . . lower projection portion,
23*a*, 23*b* . . . coupling block,
25 . . . guide portion,
26, 26*a*, 26*b* . . . stopper,
31, 32 . . . bolt,
33 . . . through-hole,
34 . . . hole with a bottom,
35 . . . locating pin,
40, 40*a* . . . lid portion,
41 . . . first guide tool,
410 . . . first connection mechanism,
411 . . . first screw shaft,
412 . . . first nut,
413 . . . supporting portion,
413*a* . . . fulcrum portion,
41*a* . . . first coupling pin,
42, 44' . . . second guide tool,
420 . . . second connection mechanism,
421 . . . second screw shaft,
422 . . . second nut,
423*a* . . . depth member,
423*b* . . . width member,
424 . . . stopper,
42*a* . . . second coupling pin,
43 . . . front portion,
44 . . . bracket,
45 . . . fulcrum pin,
47 . . . guide piece,
D1, D2 . . . dot,
E . . . eccentric pin,
H . . . line head,
L . . . line head portion,
M . . . center shaft,
P . . . first attaching portion (attaching portion), and
Q . . . second attaching portion (attaching portion)

The invention claimed is:

1. An inkjet recording apparatus performing recording to a recording medium using line heads, wherein the inkjet recording apparatus comprises a rectangular first base plate, a rectangular second base plate, and a plurality of line heads arranged on the first base plate and the second base plate, wherein a side end of one side of the first base plate has a step-like upper projection portion, a side end of the other side of the second base plate has a step-like lower projection portion, the upper projection portion and the lower projection portion overlap each other vertically so as to come in surface contact with each other and the first base plate and the second base plate are arranged side by side in a state where a distal end of the lower projection portion has been caused to abut on the first base plate, wherein a resolution is changed by finely moving the second base plate to the first base plate in a longitudinal direction.

2. The inkjet recording apparatus according to claim 1, wherein a nozzle pitch in the line heads is constant and the second base plate is finely moved to the first base plate by ½ of the nozzle pitch.

3. The inkjet recording apparatus according to claim 1, wherein a coupling block is fixed on the second base plate, a projection-like guide portion is provided on a lower face of the coupling block, an elongated groove portion extending in the longitudinal direction is provided on an upper face of the first base plate, and the guide portion is inserted in the elongated groove portion.

4. The inkjet recording apparatus according to claim 1, wherein an adjusting block is fixed on the first base plate, a coupling block is fixed on the second base plate, and a stopper is attached on the coupling block, wherein when the second base plate is not finely moved, a gap is provided between a distal end of the stopper and the adjusting block, and when the second base plate has been finely moved, the distal end of the stopper is caused to abut on the adjusting block.

5. The inkjet recording apparatus according to claim 4, wherein a pair of stoppers are attached on the second base plate via the coupling block, and the adjusting block is arranged between the stoppers.

6. The inkjet recording apparatus according to claim 1, wherein a through-hole is provided in the upper projection portion, a hole with a bottom is provided in the lower projection portion, and a locating pin can be fitted from the side of the through-hole in a state where the through-hole and the hole with a bottom are caused to coincide with each other.

7. The inkjet recording apparatus according to claim 1, further comprising a head box having a notched portion, wherein the first base plate and the second base plate are attached to a depth side of the notched portion, a lid portion temporarily fixing the first base plate and the second base plate simultaneously is attached to a near side of the notched portion, and the lid portion is composed of a first guide tool coupled to the first base plate, a second guide tool coupled to the second base plate, and a front portion supporting the first guide tool and the second guide tool, wherein the first base plate can be finely turned by actuating the first guide tool, and the second base plate can be finely moved by actuating the second guide tool.

8. The inkjet recording apparatus according to claim 7, wherein the first guide tool is composed of a first connection mechanism pivoted to the first base plate via a first coupling pin, a first nut attached with the first connection mechanism, and a first screw shaft attached with the first nut, wherein the first base plate is finely turned by rotating the first screw shaft.

9. The inkjet recording apparatus according to claim 8, wherein the first connection mechanism is composed of a supporting portion extending in a horizontal direction approximately orthogonal to the first screw shaft, and a fulcrum portion attached to a distal end of the supporting portion, the supporting portion is attached to the first nut, and a center shaft of the fulcrum portion is fixed and one end of the fulcrum portion is pivoted to the first base plate via the first coupling pin.

10. The inkjet recording apparatus according to claim 7, wherein the second guide tool is composed of a second connection mechanism attached to the second base plate via a second coupling pin, a second nut attached with the second connection mechanism, and a second screw shaft attached with the second nut, wherein the second base plate is finely moved by rotating the second screw shaft.

11. The inkjet recording apparatus according to claim 10, wherein the second connection mechanism is composed of a width member finely movable in a front-rear direction and a depth member attached to the width member via an eccentric pin, the depth member is attached to the second nut, and the width member is attached to the second base plate via the second coupling pin.

12. The inkjet recording apparatus according to claim 10, wherein stoppers are provided ahead of and behind the depth member.

* * * * *